US005918775A

United States Patent [19]

Arcese et al.

[11] Patent Number: 5,918,775

[45] Date of Patent: Jul. 6, 1999

[54] LIQUID DISPENSER

[75] Inventors: Edward R Arcese, Waltham; Edward R Arcese, Jr., Marlborough, both of Mass.

[73] Assignee: Liquid Dispenser, Waltham, Mass.

[21] Appl. No.: 08/869,261

[22] Filed: Jun. 4, 1997

[51] Int. Cl.[6] ..... B65D 47/00; B67D 3/00

[52] U.S. Cl. ..... 222/181.3; 222/548; 222/554; 251/288; 251/312

[58] Field of Search ..... 222/554, 544, 222/505, 181.3, 181.2, 363, 368, 548; 251/309, 288, 312

[56] References Cited

U.S. PATENT DOCUMENTS 526,578 9/1894 Lippincott ..... 222/554
2,675,207 4/1954 Mueller ..... 251/288
5,139,172 8/1992 Brown ..... 222/554 X

*Primary Examiner*—Andres Kashnikow
*Assistant Examiner*—Sean O. O'Hanlon
*Attorney, Agent, or Firm*—Mark P. White

[57] ABSTRACT

A simplified liquid dispenser comprises a hopper formed at the bottom into a base through which a base passage is drilled. The hopper contains the liquid to be dispensed. A rotary plug valve controls the flow of the liquid through the base. The plug valve is formed by a shaft journal which mates with a base bore which intersects the base passage at right angles. The shaft journal contains a shaft passage which, when aligned with the base passage, allows the liquid to flow out of the dispenser, and when not aligned with the base passage, prevents the exit of the liquid. A shaft handle contains a slot through which a restraining screw is attached to the base, allowing the rotation of the shaft through ninety degrees. The dispenser is fabricated from a hard, slippery plastic material, obviating the need for bearings.

3 Claims, 3 Drawing Sheets

LIQUID DISPENSER

BACKGROUND OF THE INVENTION

1. Field of the Invention

The present invention relates to liquid dispensers, and more specifically to liquid dispensers for dispensing high-viscosity liquids, especially soaps, shampoos, and the like.

2. Description Relative to the Prior Art

Dispensers for liquids, such as soaps and shampoos, are well known. Among the most popular of these is the pump type found in public lavatories, and factory and company washrooms. Wodeslavsk's U.S. Pat. No. 5,469,990, entitled Self Cleaning Liquid Soap Dispenser is typical of these. Wodeslavsk's invention comprises a multiplicity of moving parts, with the accompanying problem of short mean time between failures, and the necessity of frequent repair and overhaul. Chen's Automatic Liquid Soap Dispenser, U.S. Pat. No. 5,507,413, exhibits a similar complexity of construction.

The current invention provides a low cost, highly simplified alternative to the complicated and expensive dispensers currently used. This invention utilizes a rotary plug valve without gaskets, seals, o-rings, spring clips, or the like. Although rotary plug valves extensively described and used in a multitude of applications for many years, the plug valve described in the current invention has the advantage of simplicity. Because the material of the current invention is a plastic made of a slippery material, and having low friction, the valve does not require bearings. Because the valve is intended for use with a viscous liquid, such as liquid soap, the valve does not require gaskets or seals.

The current invention has only a single moving part. The current invention is not subject to clogging, and when necessary, can be disassembled for cleaning by the removal of a single screw. For these reasons, the current invention presents a significant improvement in simplicity and ease of manufacture and maintenance over the prior art.

SUMMARY OF THE INVENTION

A general object of the current invention is to provide a simple, low cost, low maintenance dispenser for liquids such as soaps or shampoos. A specific object of the current invention is to provide said dispenser with a minimum of separate parts.

According to one aspect of the invention, the invention comprises a a hopper which serves as a liquid reservoir, a base rigidly affixed to the hopper, through which a base passage is drilled, and a rotary plug valve affixed to the base passage. In the open position the liquid in the hopper may flow through the base passage and exit the dispenser. In the closed position the liquid is prevented from flowing out of the hopper.

According to another aspect of the invention the dispenser rotary plug valve comprises a shaft journal through which a shaft passage is bored, said shaft journal mating with a base bore which intersects the base passage.

According to still another aspect of the invention the dispenser further comprises a shaft handle rigidly affixed to the shaft journal. According to still another aspect of the invention the dispenser further comprises means for restraining the rotation of the shaft journal to ninety degrees. According to yet another aspect of the invention the dispenser further comprises means for restraining the shaft journal so that it may not be withdrawn from the shaft bore.

According to a final aspect of the invention the means for restraining the shaft journal further comprises a slot in the shaft handle and a restraining screw having a shank and a head, the shank of the screw passing through the slot and the screw being fastened to the base.

BRIEF DESCRIPTION OF THE DRAWINGS

These, and further features of the invention, may be better understood with reference to the accompanying specification and drawings depicting the preferred embodiment, in which.

DETAILED DESCRIPTION OF THE PREFERRED EMBODIMENTS

Figure 1:
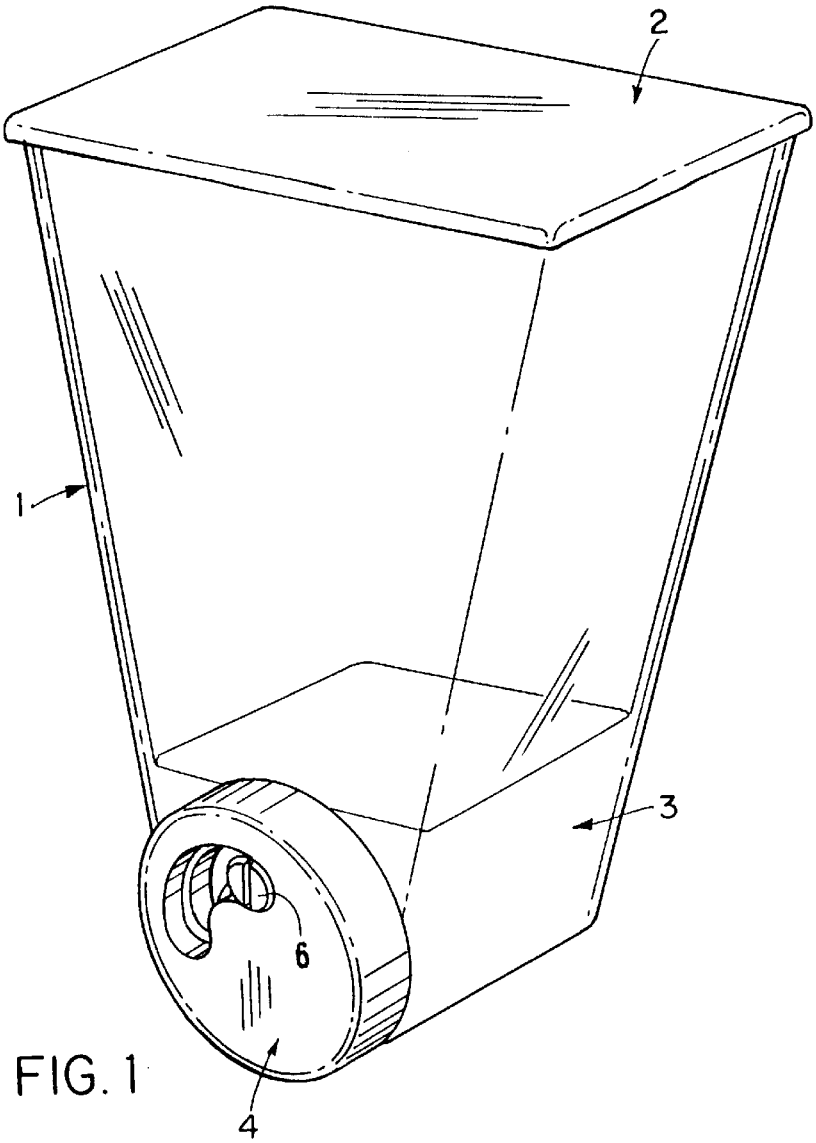
FIG. 1 depicts a three-dimensional view of the assembled dispenser.

The preferred embodiments may be understood by first referring to FIG. 1, which depicts the invention as viewed from the front.

As seen in FIG. 1, the dispenser comprises a hopper1 which contains the liquid to be dispensed. The hopper cover 2 sits atop the hopper. The hopper tapers down to a base 3, into which the valve shaft handle 4 is mounted.

Figure 2:
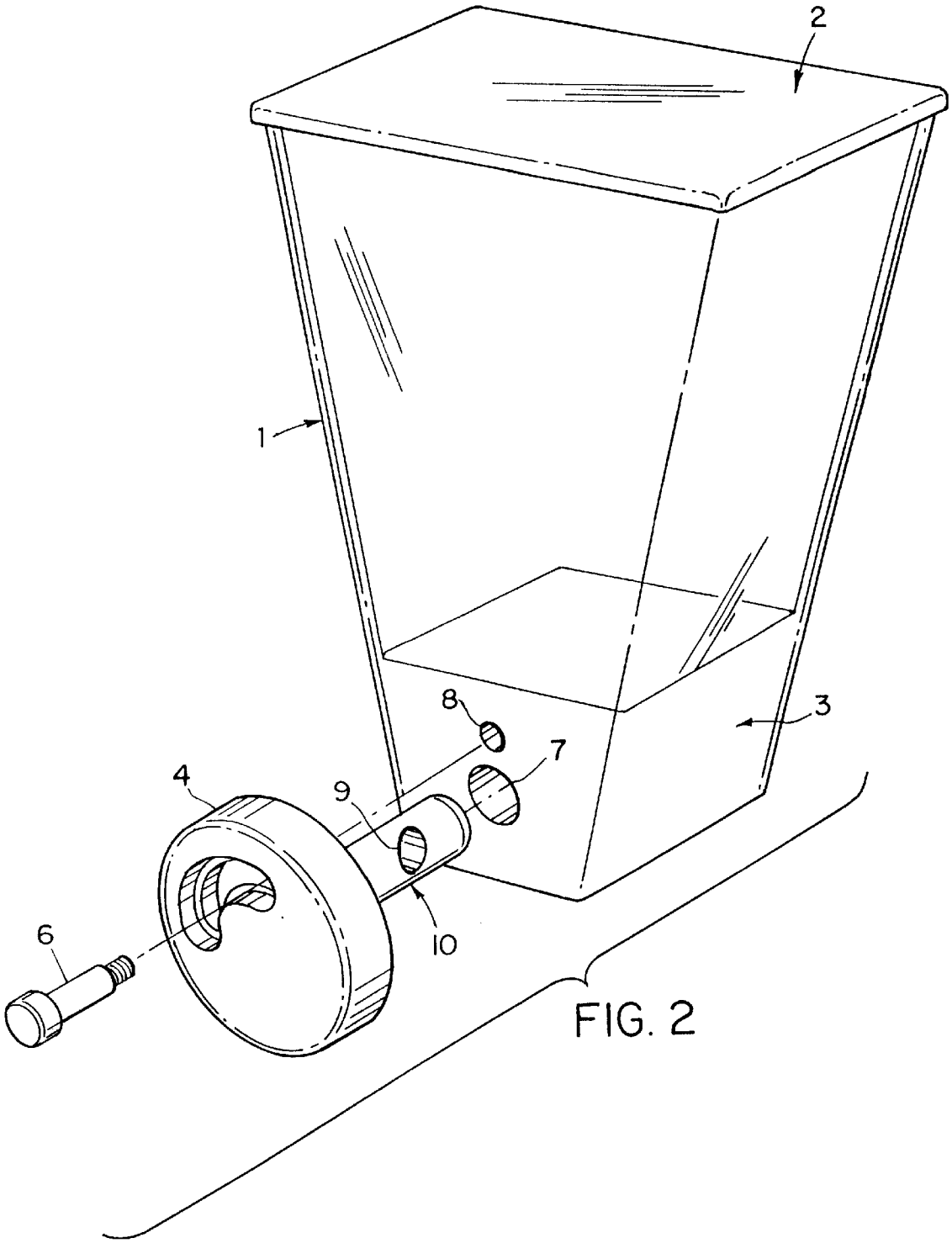
FIG. 2 depicts the dispenser with an exploded view of the valve shaft and retaining screw.

Referring next to FIG. 2 it is disclosed that the valve shaft is integrally comprised of handle 4 and journal 10, into which shaft passage 9 is drilled. Retaining screw 6 extends through valve shaft slot 5, and is affixed into threaded hole 8 in base 3.

Figure 3:
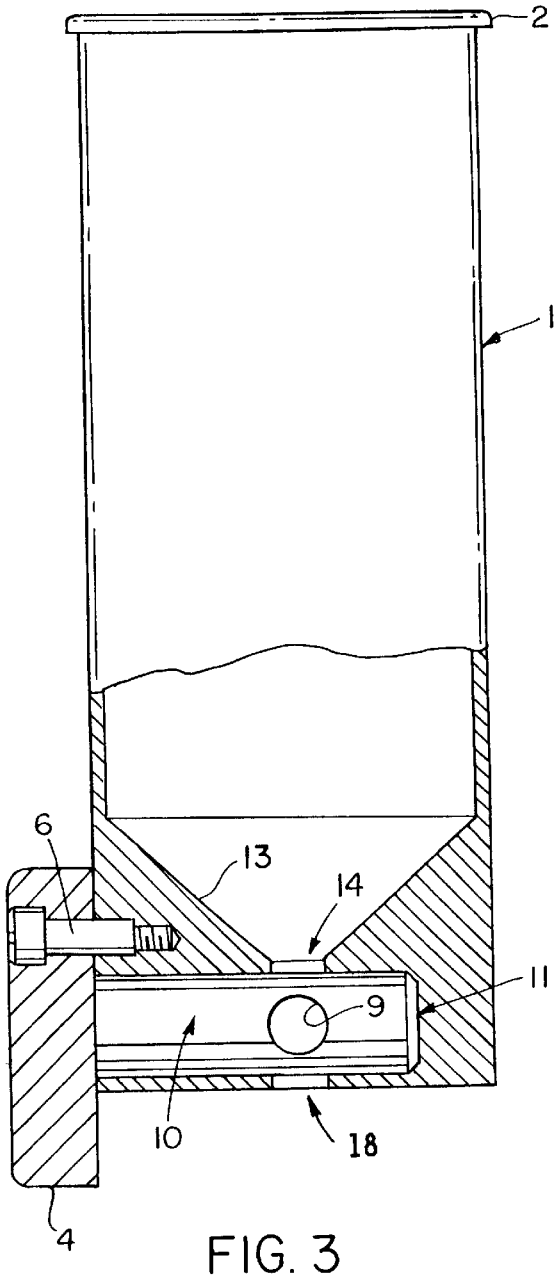
FIG. 3 depicts a cross-section view of the assembled dispenser as viewed from the right side.

Referring now to FIG. 3, it is seen that base passage 14 extends though base 3, allowing the passage of the liquid through shaft passage 9, when the shaft is so rotated that shaft passage 9 is aligned with base passage 14. Base passage funnel 13 provides a smooth flow of the liquid into base passage 14.

The end of the valve shaft is formed into a shoulder 11 which conforms to the shape of the inside end of base bore 7. This shoulder provides for a smooth mating of the shaft journal and the base bore.

The retaining screw 6 prevents the shaft journal from leaving the base bore. Because the retaining screw fits into a valve shaft slot 5, the handle may be rotated to the extent allowed by the slot.

Figure 4:
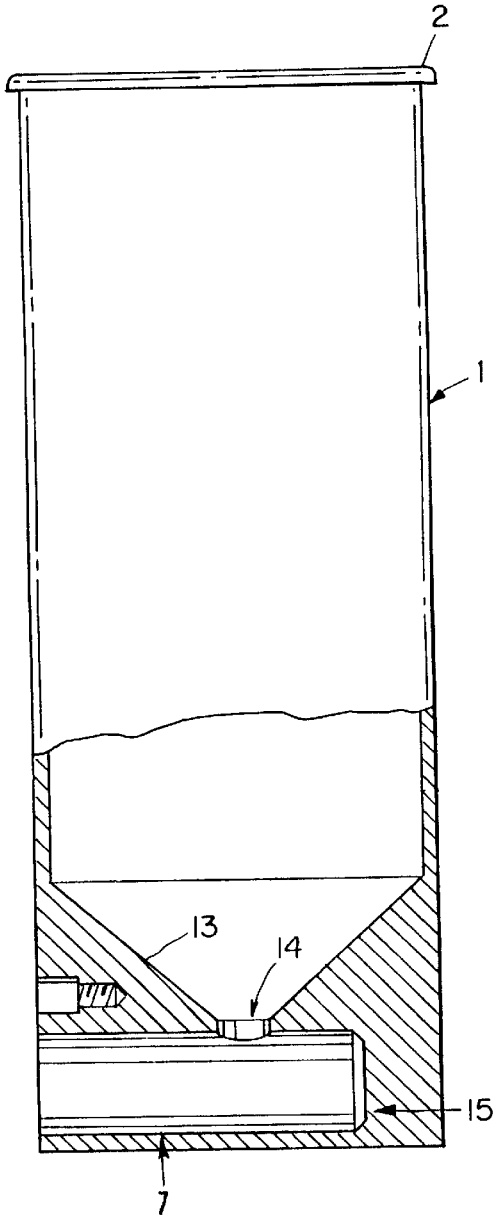
FIG. 4 depicts a cross-section view of the dispenser as viewed from the right side with the valve shaft removed.

FIG. 4 shows the view of FIG. 3 with the valve shaft removed. It may be seen, referring to FIG. 4, that the end of shaft bore 7 is formed into internal shoulder 15 to mate with the shoulder 11 of shaft journal 10.

Figure 5:
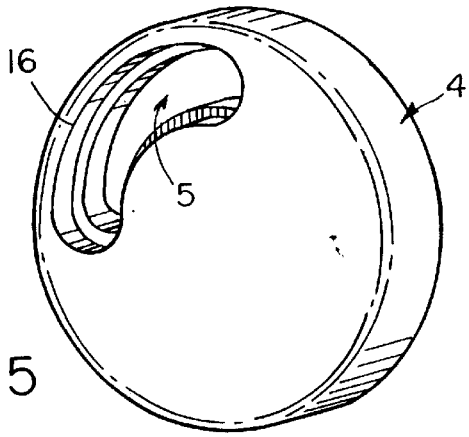
FIG. 5 depicts a three-dimensional view of the valve-shaft handle.

Referring now to FIG. 5, recess 16 surrounds slot 5 to allow the head of retaining screw 6 to be inserted flush with the surface of shaft handle 4. The slot is sufficiently long so that the shaft handle may be rotated over ninety degrees, so as to allow the shaft passage to rotate from completely open to completely closed position.

In the preferred embodiment the dispenser is manufactured by injection molding from a plastic material,. The hopper is 5.00 inches wide at the top when viewed from the from the front, and 2.50 inches at the point that it joins the base. The base is 1.75 inches in height. Viewed from the side, the hopper and base are 2.50 inches in width.

The shaft journal is 0.625 inches in diameter. The shaft handle is 2 inches in diameter. Both the shaft passage and the base passage are 0.375 inches in diameter.

Because of the contemplated use of this dispenser, the retaining screw is made of plastic or other non-corroding material. This retaining screw is not expected to take any significant load, since its only function is to keep the valve shaft from sliding out of the base bore.

It is contemplated that this liquid dispenser will be mounted against a wall, with the surfaces opposite the valve handle being flush with the wall. In particular, this invention is well suited for dispensing liquid soap and shampoo in a shower or bath area. As such, the back of the dispenser can be permanently affixed to the wall, and need never be removed.

While the invention has been described with reference to specific embodiments, it will be apparent that improvements and modifications may be made within the purview of the invention without departing from the scope of the invention defined in the appended claims.

We claim:

1. A liquid dispenser comprising:

a hopper which serves as a liquid reservoir;

a base rigidly affixed to the hopper, containing a base passage which communicates with the hopper, and a cylindrical base bore intersecting said base passage;

a rotary plug valve comprising a cylindrical shaft journal rotatably inserted into the mating base bore, said shaft journal containing a shaft passage which communicates with the base passage;

a shaft handle in the form of a slotted disc rigidly affixed to an end of the shaft journal; and a single restraining means both confining said shaft journal within said base bore, and limiting rotation of said shaft handle.

2. The dispenser of claim 1, wherein said restraining means comprises a screw affixed to the base and slideably engaged in said shaft handle slot, said screw comprising a head of diameter in excess of the slot width, said head remaining without the slot.

3. The dispenser of claim 2, wherein the shaft journal further comprises a shoulder, the shaft passage further comprises a mating internal shoulder.

* * * * *